US009701125B2

(12) United States Patent
Ando et al.

(10) Patent No.: US 9,701,125 B2
(45) Date of Patent: Jul. 11, 2017

(54) PRINTING APPARATUS AND MAINTENANCE METHOD FOR PRINTING APPARATUS

(71) Applicant: SEIKO EPSON CORPORATION, Tokyo (JP)

(72) Inventors: Masaaki Ando, Matsumoto (JP); Shinya Komatsu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/097,130

(22) Filed: Apr. 12, 2016

(65) Prior Publication Data

US 2016/0303858 A1 Oct. 20, 2016

(30) Foreign Application Priority Data

Apr. 14, 2015 (JP) ..... 2015-082733

(51) Int. Cl.
*B41J 2/165* (2006.01)
*B41J 2/175* (2006.01)

(52) U.S. Cl.
CPC ..... *B41J 2/16535* (2013.01); *B41J 2/17556* (2013.01); *B41J 2/17596* (2013.01)

(58) Field of Classification Search
None
See application file for complete search history.

(56) References Cited

U.S. PATENT DOCUMENTS

2008/0273046 A1 11/2008 Ishinaga
2010/0321425 A1* 12/2010 Kanke ..... B41J 2/1652 347/6
2011/0141167 A1 6/2011 Kikkawa
2013/0106963 A1* 5/2013 Kawase ..... B41J 2/17509 347/85
2014/0253633 A1 9/2014 Kobayashi et al.
2014/0292915 A1* 10/2014 Onodera ..... B41J 2/16538 347/33
2015/0077473 A1* 3/2015 Wanibe ..... B41J 2/14072 347/50

FOREIGN PATENT DOCUMENTS

JP 2014-172238 9/2014

* cited by examiner

*Primary Examiner* — Matthew Luu
*Assistant Examiner* — Tracey McMillion
(74) *Attorney, Agent, or Firm* — Workman Nydegger

(57) ABSTRACT

A printing apparatus includes an ink discharge head that discharges ink, a wiper that wipes the ink discharge head, a sub tank that stores the ink to be supplied to the ink discharge head, an ink circulation flow path, a circulation pump that causes the ink to circulate in the ink circulation flow path, and a first pressurizing unit that pressurizes the inside of the sub tank in the wiping operation in which the ink discharge head is wiped with the wiper to a first pressure that is higher than the pressure in the sub tank in the print operation for discharging the ink toward a print medium with the ink discharge head. The circulation pump stops the operation in the wiping operation.

7 Claims, 3 Drawing Sheets

PRINTING APPARATUS AND MAINTENANCE METHOD FOR PRINTING APPARATUS

BACKGROUND

1. Technical Field

The present invention relates to a printing apparatus that performs maintenance of an ink discharge head, and a maintenance method for a printing apparatus.

2. Related Art

In the related art, there has been known a printer that includes a print head for discharging ink, a wiper for wiping the print head, a tank that stores the ink to be supplied to the print head, and an ink circulation mechanism that circulates the ink between the tank and the print head. This printer performs pressure cleaning of the print head in which the printer increases the ink circulation speed to a speed faster than that in print operation, applies a pressure to the ink to discharge the ink from a nozzle of the print head, and then, in a state where the pressure application to the ink is stopped, wipes the print head with the wiper (see, for example JP-A-2014-172238).

The inventor has found the following problems. Known printing apparatuses such as printers increase an ink circulation speed in wiping operation to a speed higher than that in print operation to increase a back pressure in an ink discharge head (hereinafter, referred to as "head back pressure") in the wiping operation to be higher than a head back pressure in the print operation so as to prevent, for example, bubbles from entering the inside of the ink discharge head from the nozzle. If the ink is circulated in the wiping operation, however, it is difficult to control the head back pressure to remain within a desired range because the ink pressure loss in the ink circulation flow path varies along with variation in ink viscosity.

SUMMARY

An advantage of some aspects of the invention is to provide a printing apparatus capable of accurately controlling a head back pressure in wiping operation such that the head back pressure is higher than a head back pressure in print operation, and a maintenance method for a printing apparatus.

A printing apparatus according to an aspect of the invention includes an ink discharge head that discharges ink, a wiping member that wipes the ink discharge head, an ink storage section that stores the ink to be supplied to the ink discharge head, an ink circulation flow path including a forward circulation path through which the ink supplied from the ink storage section to the ink discharge head flows and a backward circulation path through which the ink returning from the ink discharge head to the ink storage section flows, a circulation section that causes the ink to circulate in the ink circulation flow path, and a first pressurizing section that pressurizes the inside of the ink storage section in wiping operation in which the ink discharge head is wiped with the wiping member to a first pressure that is higher than a pressure in the ink storage section in print operation for discharging the ink toward a print medium with the ink discharge head. The circulation section stops the operation in the wiping operation.

In this structure, in the wiping operation, the first pressurizing section pressurizes the inside of the ink storage section to the first pressure. This increases the head back pressure in the wiping operation to be higher than a head back pressure in the print operation. Further, the ink circulation is stopped in the wiping operation. Consequently, the amount of variation of the head back pressure due to variation in ink viscosity can be reduced. Accordingly, by this structure, the head back pressure in the wiping operation can be accurately controlled so as to be higher than the head back pressure in the print operation.

In this case, it is preferable that the printing apparatus further include a second pressurizing section that pressurizes the inside of the ink storage section to a second pressure that is higher than the first pressure and a switching section that performs switching between the first pressurizing section in the wiping operation and the second pressurizing section in discharge cleaning operation in which the ink is discharged from the ink discharge head.

In this structure, in the wiping operation, switching is performed to select the first pressurizing section, and thereby the inside of the ink storage section is pressurized to the first pressure. In the discharge cleaning operation, switching is performed to select the second pressurizing section, and thereby the inside of the ink storage section is pressurized to the second pressure. Consequently, by this structure, the pressure applied to pressurize the inside of the ink storage section can be immediately switched between the pressure in the wiping operation and the pressure in the discharge cleaning operation.

In this case, it is preferable that the switching section include a switching valve for switching between a state in which the first pressurizing section communicates with the ink storage section and a state in which the second pressurizing section communicates with the ink storage section.

In this case, it is preferable that the first pressurizing section include a pressure pump that is to be a pressurizing source, a first pressure buffer tank provided between the pressure pump and the ink storage section, and a first pressure sensor that detects a pressure in the first pressure buffer tank. The pressure pump is controlled based on the detection result of the first pressure sensor.

In this structure, the pressure in the first pressure buffer tank can be accurately controlled. Accordingly, by the first pressure buffer tank controlled to have an appropriate pressure, the inside of the ink storage section can be pressurized.

In this case, it is preferable that the printing apparatus further include an air open valve that releases the inside of the ink storage section to the atmosphere in the print operation.

With this structure, in the print operation, the pressure in the ink storage section becomes atmospheric pressure.

In this case, it is preferable that the ink discharge head discharge ultraviolet ink (UV ink) as the ink.

In this structure, polymer substances of the UV ink may enter the inside of the ink discharge head from the nozzle in the wiping operation, and it is desired to increase the head back pressure in the wiping operation. Moreover, variation in viscosity of the UV ink depending on the temperature of the UV ink is large, and if the UV ink is circulated, it is difficult to accurately control the head back pressure. Accordingly, the aspects of the invention are particularly useful.

A maintenance method according to an aspect of the invention is a maintenance method for a printing apparatus including an ink discharge head that discharges ink, a wiping member that wipes the ink discharge head, an ink storage section that stores the ink to be supplied to the ink discharge head, an ink circulation flow path including a forward circulation path through which the ink supplied from the ink storage section to the ink discharge head flows and a backward circulation path through which the ink returning from the ink discharge head to the ink storage section flows, and a circulation section that causes the ink to circulate in the ink circulation flow path. The method includes pressurizing the inside of the ink storage section in wiping operation in which the ink discharge head is wiped with the wiping member to a first pressure that is higher than a pressure in the ink storage section in print operation for discharging the ink toward a print medium with the ink discharge head, and stopping the operation of the circulation section in the wiping operation.

According to this method, in the wiping operation, the inside of the ink storage section is pressurized to the first pressure. This increases the head back pressure in the wiping operation to be higher than the head back pressure in the print operation. Further, in the wiping operation, the ink circulation is stopped. Consequently, the amount of variation of the head back pressure due to the variation in ink viscosity can be reduced. Accordingly, in this method, the head back pressure can be accurately controlled such that the head back pressure in the wiping operation becomes higher than the head back pressure in the print operation.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
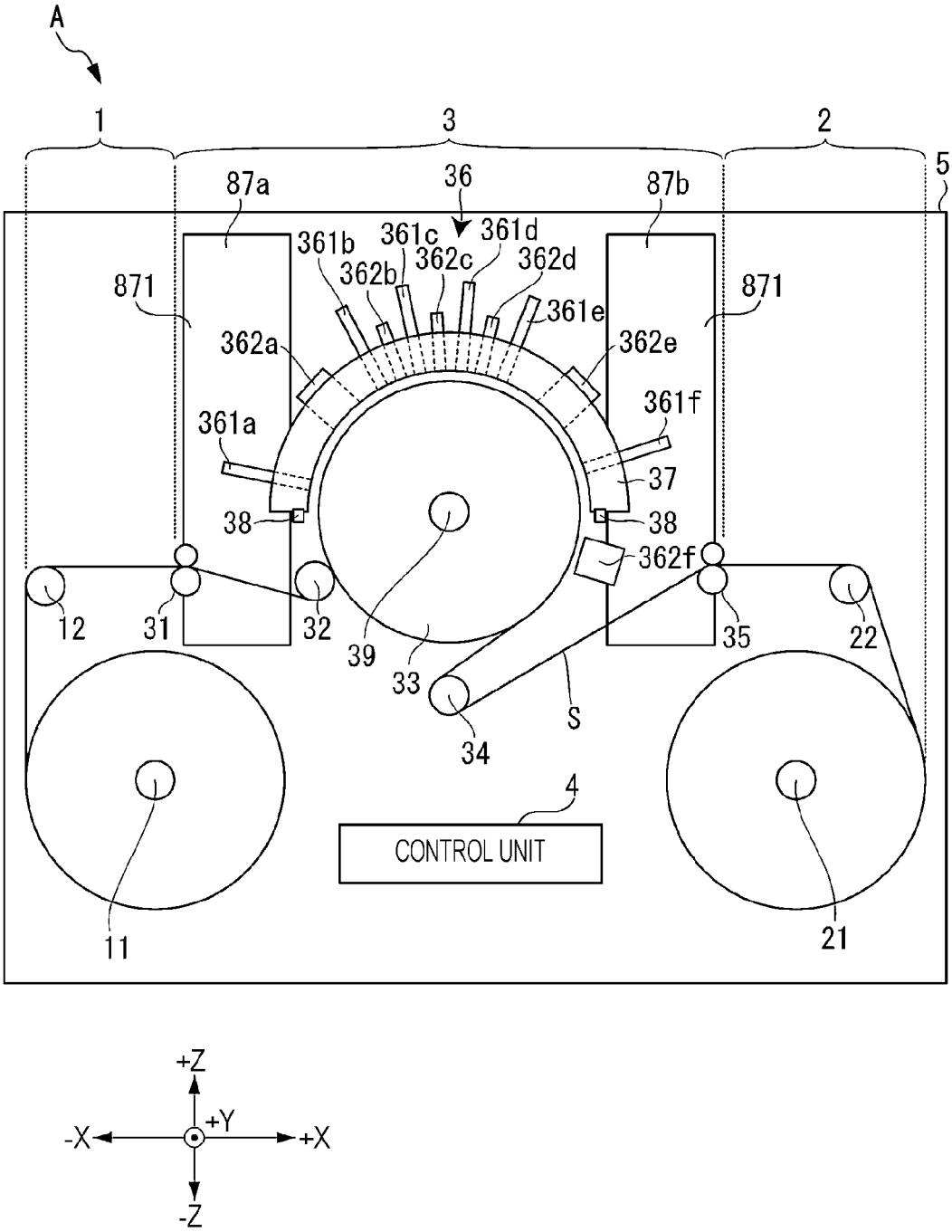
FIG. 1 is a schematic diagram of a printing apparatus according to an embodiment of the invention.

Hereinafter, a printing apparatus A according to an embodiment of the invention is described with reference to the attached drawings. In the drawings below, an XYZ orthogonal coordinate system is shown to clarify relationships among arranged components of the apparatus as needed.

With reference to FIG. 1, an overall structure of the printing apparatus A is described. The printing apparatus A discharges an ultraviolet ink (hereinafter, referred to as "UV ink") toward a print medium S that has been set, and thus performs printing. The print medium S is band-shaped continuous paper. The material of the print medium S is not limited to a particular material, various kinds of materials such as paper and films may be used.

The printing apparatus A includes a feeding section 1, a winding section 2, a print unit 3, a control unit 4, and an outer case 5. Although not shown in FIG. 1, the printing apparatus A includes a maintenance unit 6 and an ink supply system 8 (see FIG. 3).

Between the feeding section 1 and the winding section 2, the print unit 3 is arranged, and the print medium S is transported by using a roll-to-roll method. The feeding section 1 includes a feeding shaft 11 and a feeding side guide roller 12. The print medium S, which has been wound in a rolled shape, is set to the feeding shaft 11. The print medium S fed from the feeding shaft 11 is transported via the feeding side guide roller 12 to the print unit 3. The winding section 2 includes a winding shaft 21 and a winding side guide roller 22. The print medium S transported from the print unit 3 via the winding side guide roller 22 is wound around the winding shaft 21.

The print unit 3 is used to print an image onto the print medium S. The print unit 3 includes an upstream side transport roller pair 31, an upstream side guide roller 32, a rotating drum 33, a downstream side guide roller 34, a downstream side transport roller pair 35, a process unit 36, a carriage 37, and guide rails 38.

The upstream side roller pair 31 transports the print medium S fed from the feeding section 1 toward the upstream side guide roller 32. The upstream side guide roller 32 guides the transport of the print medium S such that the print medium S is turned between the upstream side transport roller pair 31 and the rotating drum 33. The rotating drum 33 is a cylindrical drum that can rotate about a rotation shaft 39 extending in the Y directions. The rotating drum 33 is driven and rotated by the frictional force between the surface thereof and the print medium S when the print medium S is transported along the surface of the rotating drum 33. The rotating drum 33 functions as a platen for ink discharge heads 361 which will be described below. The downstream side guide roller 34 guides the transport of the print medium S such that the print medium S is turned between the rotating drum 33 and the downstream side transport roller pair 35. The downstream side roller pair 35 transports the print medium S transported from the downstream side guide roller 34 toward the winding section 2.

The process unit 36 includes six ink discharge heads 361*a* to 361*f*, and six UV radiators 362*a* to 362*f*. The number of the elements is merely an example, and similarly, the number of elements described below is merely an example. Note that when it is not necessary to distinguish the six ink discharge heads 361*a* to 361*f* from each other, the ink discharge heads are referred to as an ink discharge head or ink discharge heads 361". Similarly, when it is not necessary to distinguish the six UV radiators 362*a* to 362*f*, the UV radiators are referred to as "a UV radiator or UV radiators 362".

In the process unit 36, the ink discharge heads 361*a* to 361*f*, and the UV radiators 362*a* to 362*e* are mounted on the carriage 37. The UV radiator 362*f* is not mounted on the carriage 37. The carriage 37 and the process unit 36 mounted thereon can reciprocate in the Y directions as will be described below. Guide rails 38 are respectively provided along both end portions of the carriage 37 in the X directions. The guide rails 38 support the carriage 37 such that the carriage 37 is slidable in the Y directions.

The six ink discharge heads 361 are arranged along a transport direction of the print medium S such that the ink discharge heads 361 face the surface of the rotating drum 33. The six ink discharge heads 361 correspond, from the transport upstream side of the print medium S, for example, UV inks of six colors of white, yellow, cyan, magenta, black, and clear (transparent), respectively. Each of the ink discharge heads 361 discharges the UV ink by using an ink jet method. The ink discharge heads 361 discharge the UV inks toward the print medium S supported on the surface of the rotating drum 33. This operation forms a color image onto the print medium S. It is preferable that individual back pressures (hereinafter, referred to as "head back pressures") of the UV inks in the ink discharge heads 361 be maintained, for example, within a range from −3 kPa or more and −0.4 kPa or less for good menisci.

The ink discharge head 361*a* that discharges a white UV ink is used to form a white background onto a transparent print medium S in printing an image onto the print medium S. The ink discharge head 361*b* that discharges a yellow UV ink, the ink discharge head 361*c* that discharges a cyan UV ink, the ink discharge head 361*d* that discharges a magenta UV ink, and the ink discharge head 361*e* that discharges a black UV ink are used to form a color image directly onto the print medium S, or onto the white background formed with the white UV ink. The ink discharge head 361*f* that discharges a clear UV ink is used to cover the color image with the clear UV ink.

The six UV radiators 362 are used for temporary curing or final curing. The UV radiators 362*b* to 362*d* are used for temporary curing. The UV radiator 362*b* is provided between the ink discharge head 361*b* and the ink discharge head 361*c*. The UV radiator 362*c* is provided between the ink discharge head 361*c* and the ink discharge head 361*d*. The UV radiator 362*d* is provided between the ink discharge head 361*d* and the ink discharge head 361*e*. The UV radiators 362*b* to 362*d* for temporary curing irradiate the print medium S on which the UV ink has been discharged with ultraviolet rays of an accumulated amount of light of a degree that the wet-spreading of the UV ink is delayed. This reduces the occurrence of color mixture due to mixture of the UV inks discharged from individual ink discharge heads 361*b* to 361*e*.

The UV radiators 362*a*, 362*e*, and 362*f* are used for final curing. The UV radiator 362*a* is provided between the ink discharge head 361*a* and the ink discharge head 361*b*. The UV radiator 362*e* is provided between the ink discharge head 361*e* and the ink discharge head 361*f*. The UV radiator 362*f* is provided at a position downstream of the ink discharge head 361*f*. The UV radiators 362 for final curing irradiate the print medium S on which the UV ink has been discharged with ultraviolet rays of an accumulated amount of light of a degree the wet-spreading of the UV ink is stopped. With this radiation, the UV ink ejected onto the print medium S is completely cured, and fixed on the print medium S.

Two ink supply units 87*a* and 87*b* are arranged in line at the carriage 37 in the X directions. When it is not necessary to distinguish the two ink supply units 87*a* and 87*b*, the ink supply units are referred to as an ink supply unit or ink supply units 87". Each of the ink supply units 87 includes three ink supply sections 82 (see FIG. 3) and a storage section 871 that accommodates the ink supply sections 82. The three ink supply sections 82 provided in the ink supply unit 87*a* at the −X side supply individual UV inks to the ink discharge heads 361*a* to 361*c*, respectively. The three ink supply sections 82 provided in the ink supply unit 87*b* at the +X side supply individual UV inks to the ink discharge heads 361*d* to 361*f*, respectively. The ink supply sections 82 are included in an ink supply system 8 (see FIG. 3) described below.

The control unit 4 includes a central processing unit (CPU) and various memories. The control unit 4 controls individual parts of the printing apparatus A. The outer case 5 accommodates the feeding section 1, the winding section 2, the print unit 3, the control unit 4, the maintenance unit 6, and the ink supply system 8.

Figure 2:
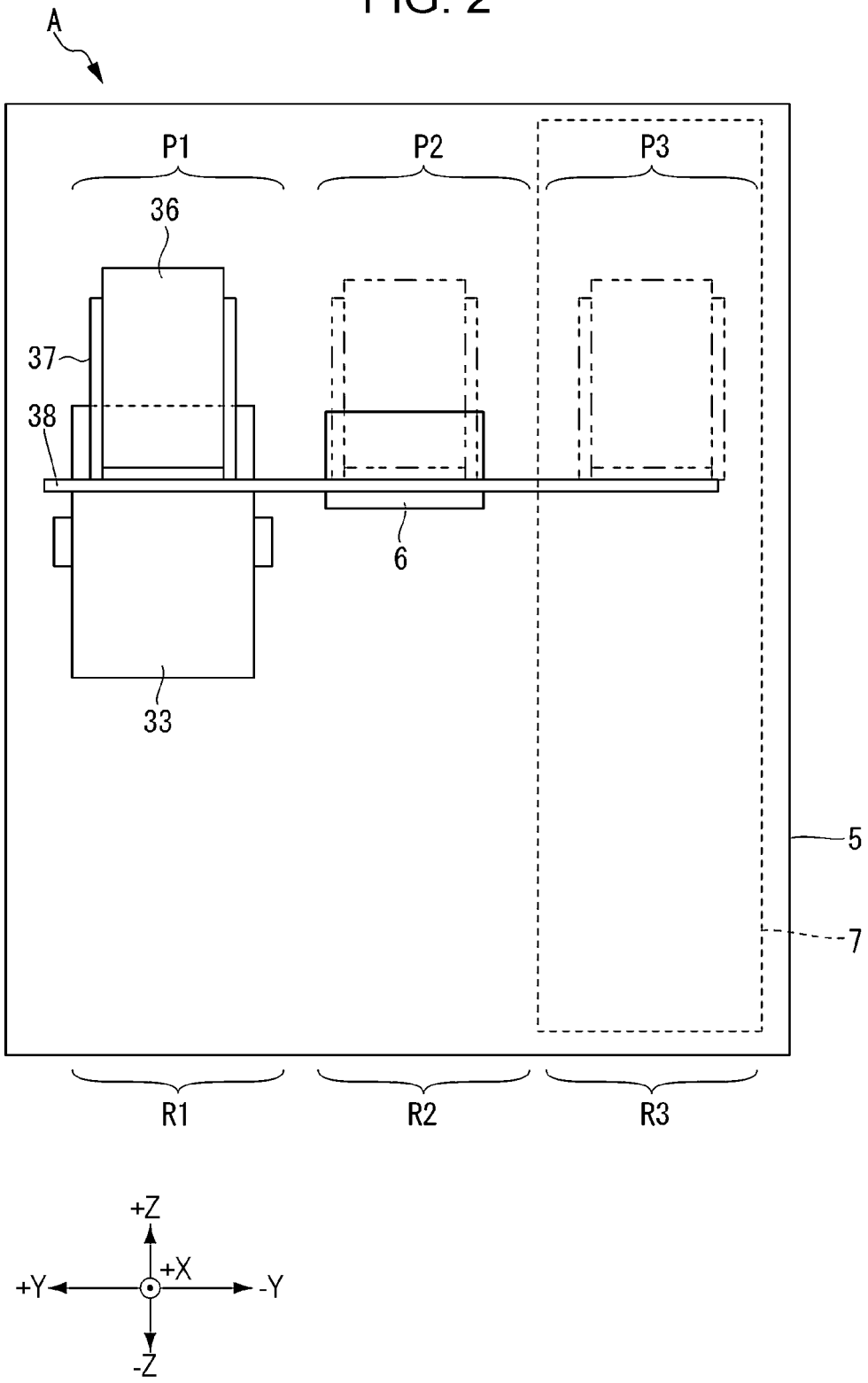
FIG. 2 illustrates movement of a carriage in an outer case of the printing apparatus illustrated in FIG. 1.

With reference to FIG. 2, movement of the carriage 37 in the Y directions in the outer case 5 is described. In the outer case 5, from the +Y side, a print region R1, an automatic maintenance region R2, and a manual maintenance region R3 are provided. In the print region R1, the feeding section 1, the winding section 2, and the rotating drum 33, and other components are provided. In the automatic maintenance region R2, six maintenance units 6 corresponding to the respective six ink discharge heads 361 are provided (in FIG. 2, only one maintenance unit 6 is shown). In the manual maintenance region R3, a work space 7 where an operator can enter is provided.

The carriage 37 and the process unit 36 mounted thereon can move, from the +Y side, to a print position P1, an automatic maintenance position P2, and a manual maintenance position P3 by using a movement mechanism (not shown). The print position P1 is provided in the print region R1, the automatic maintenance position P2 is provided in the automatic maintenance region R2, and the manual maintenance position P3 is provided in the manual maintenance region R3.

The process unit 36 faces the rotating drum 33 when the process unit 36 is positioned at the print position P1. In this state, print operation is performed by the process unit 36 onto the print medium S supported by the rotating drum 33. When the process unit 36 is positioned at the automatic maintenance position P2, maintenance processing is automatically performed by the maintenance unit 6 to individual ink discharge heads of the ink discharge heads 361. When the process unit 36 is positioned at the manual maintenance position P3, the −Z side of the process unit 36 is opened and the work space is provided. In this work space, an operator entering the work space 7 performs manual maintenance of the process unit 36, for example, wiping of the UV ink.

Figure 3:
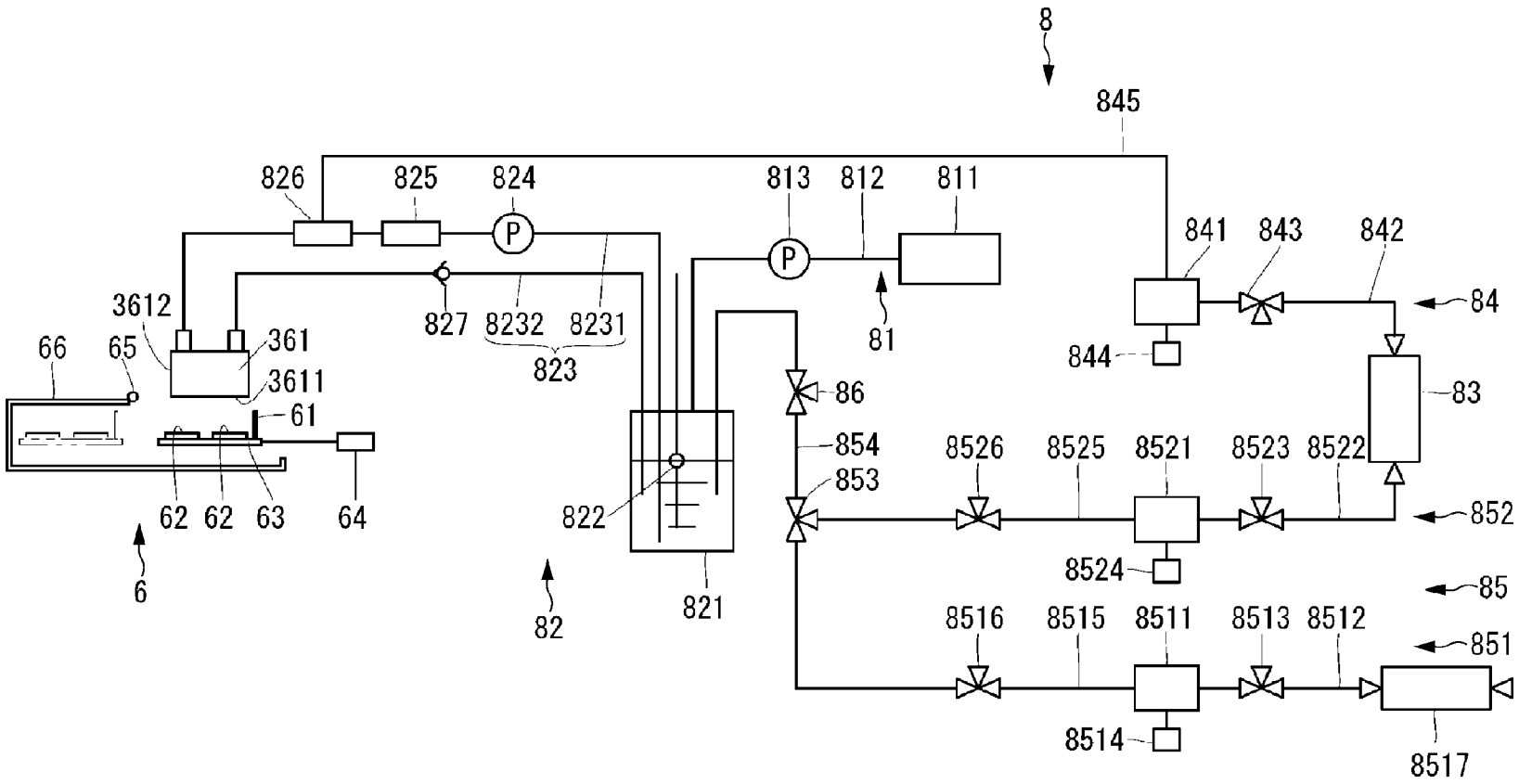
FIG. 3 illustrates a structure of a maintenance unit and an ink supply system in the printing apparatus illustrated in FIG. 1.

With reference to FIG. 3, the maintenance unit 6 and the ink supply system 8 will be described. As described above, the printing apparatus A includes the six ink discharge heads 361, the six maintenance units 6, and the six ink supply sections 82, and these components have similar structures in six heads, units, and sections respectively. Consequently, in FIG. 3, one ink discharge head 361, one maintenance unit 6, and one ink supply section 82 are illustrated.

The maintenance unit 6 includes a wiper 61, caps 62, a supporting member 63, a maintenance moving mechanism 64, a cleaning liquid ejection head 65, and a cover 66.

The wiper 61 wipes a nozzle surface 3611 of the ink discharge head 361. The wiper 61 may be, for example, a blade-shaped wiper. The caps 62 seal the nozzle surface 3611. The wiper 61 and the caps 62 are supported by a supporting member 63.

The maintenance moving mechanism 64 reciprocates the wiper 61 and the caps 62 on the supporting member 63. The cleaning liquid ejection head 65 is positioned laterally to the ink discharge head 361, and provided at one end portion of the cover 66. The cleaning liquid ejection head 65 ejects a cleaning liquid toward an ejection target surface 3612 that is a side surface of the ink discharge head 361 at the cleaning liquid ejection head 65 side. The cover 66 receives waste liquid containing the ink, the cleaning liquid, or the like produced during the maintenance operation. Further, the cover 66 shields the ultraviolet rays emitted from the UV radiator 362 to reduce the curing of the UV ink adhered to the wiper 61 and the caps 62.

In the maintenance unit 6 structured as described above, the caps 62 are moved to positions opposed to the ink discharge head 361 by the maintenance moving mechanism 64 so as to receive the discharged UV ink by using the caps 62 during the discharge cleaning in which the UV ink is discharged from the ink discharge head 361. By this discharge cleaning, bubbles, foreign matters, and the like are discharged together with the UV ink from the nozzle of the ink discharge head 361. The ink discharge head 361 can be brought into contact with the caps 62. With this structure, capping and release of the capping of the ink discharge head 361 with the caps 62 can be performed.

After the discharge cleaning, the wiper 61 is moved in the X directions by the maintenance moving mechanism 64. By this movement, the nozzle surface 3611 of the ink discharge head 361 is wiped with the wiper 61, and the UV ink adhered to the nozzle surface 3611 is wiped. In some cases, the wiping is performed in a state in which the cleaning liquid is ejected onto the ejection target surface 3612 and in some cases, the wiping is performed in a state in which the cleaning liquid is not ejected onto the ejection target surface 3612.

The ink supply system 8 includes an ink replenishment section 81, an ink supply section 82, a pressure-regulating pump 83, a pressure reducing section 84, a tank pressurizing section 85, and a tank release valve 86. One pressure-regulating pump 83 is shared by the six ink supply sections 82. Similarly, one pressure reducing section 84 and one tank pressurizing section 85 are shared by the six ink supply sections 82.

The ink replenishment section 81 replenishes the UV ink to the ink supply section 82. The ink replenishment section 81 includes a cartridge attachment portion 811, a replenishment flow path 812, and a replenishment pump 813.

To the cartridge attachment portion 811, an ink cartridge (not shown) is attached. The UV ink is supplied from the ink cartridge attached to the cartridge attachment portion 811 via a sub tank 821 of the ink supply section 82 to the ink discharge head 361. The cartridge attachment portion 811 is connected to the sub tank 821 via the replenishment flow path 812. To the replenishment flow path 812, the replenishment pump 813 is provided. The replenishment pump 813 feeds the UV ink stored in the ink cartridge to the sub tank 821 via the replenishment flow path 812.

The ink supply section 82 supplies the UV ink replenished from the ink replenishment section 81 to the ink discharge head 361. The ink supply section 82 includes the sub tank 821, a liquid level sensor 822, an ink circulation flow path 823, a circulation pump 824, a heat exchanger 825, a deaeration module 826, and a check valve 827.

The sub tank 821 temporarily stores the UV ink received from the ink cartridge. The sub tank 821 is an open type sub tank. As will be described below in detail, the sub tank 821 is opened to the atmosphere during print operation, pressurized to a predetermined first pressure during wiping operation, and pressurized to a predetermined second pressure during discharge cleaning operation. The first pressure is a pressure higher than the pressure in the sub tank 821 in print operation, that is, higher than an atmospheric pressure, and the first pressured is, for example, 0.1 kPa or more and 2 kPa or less. The second pressure is a pressure higher than the first pressure, and is, for example, 20 kPa or more and 60 kPa or less.

The liquid level sensor 822 detects a liquid level of the UV ink in the sub tank 821. The control unit 4 controls the replenishment pump 813 based on the detection result of the liquid level sensor 822. With this operation, the liquid level in the sub tank 821 is maintained within a predetermined range. That is, the head difference between the liquid surface of the sub tank 821 and the nozzle surface 3611 of the ink discharge head 361 is maintained within a predetermined range (for example, about 200 mm). During the print operation, the circulation of the UV ink in the ink circulation flow path 823 causes pressure loss of the ink, and the head back pressure is maintained, for example, at −1 kPa. Consequently, a good meniscus is formed in the nozzle of the ink discharge head 361.

The ink circulation flow path 823 is a flow path for the UV ink supplied from the sub tank 821 and returning to the sub tank 821 via the ink discharge head 361. The ink circulation flow path 823 includes a forward circulation path 8231 and a backward circulation path 8232.

The UV ink from the sub tank 821 passes through the forward circulation path 8231 and is supplied to the ink discharge head 361. An upstream end of the forward circulation path 8231 is inserted into the sub tank 821. A downstream end of the forward circulation path 8231 is connected to the ink discharge head 361. In the forward circulation path 8231, from the upstream side, the circulation pump 824, the heat exchanger 825, and the deaeration module 826 are provided.

The UV ink returning from the ink discharge head 361 to the sub tank 821 passes through the backward circulation path 8232. That is, the UV ink supplied from the sub tank 821 via the forward circulation path 8231 to the ink discharge head 361, but not discharged from the ink discharge head 361 returns to the sub tank 821 via the backward circulation path 8232. An upstream end of the backward circulation path 8232 is connected to the ink discharge head 361. A downstream end of the backward circulation path 8232 is inserted into the sub tank 821.

The circulation pump 824 feeds the UV ink stored in the sub tank 821 toward the ink discharge head 361. The rotational speed of the circulation pump 824 can be changed between a normal speed that is a rotational speed in the print operation and a high speed that is a rotational speed in the discharge cleaning operation. A gear pump can be preferably used as the circulation pump 824 because the gear pump can reduce a pulsing stream and provide less temporal flow rate variation.

The heat exchanger 825 performs heat exchange between warm water supplied from a hot water tank (not shown) and the UV ink flowing through the ink circulation flow path 823 to heat the UV ink flowing through the ink circulation flow path 823 to a predetermined temperature (for example, 35° C. or higher and 40° C. or lower). The predetermined temperature is a temperature at which the UV ink supplied to the ink discharge head 361 has a viscosity suitable for the discharge from the ink discharge head 361. The printing apparatus A heats the UV ink at a temperature lower than the predetermined temperature to the predetermined temperature by using the heat exchanger 825 when the printing apparatus A starts up, and then starts the print operation.

The deaeration module 826 deaerates the UV ink flowing through the ink circulation flow path 823. This operation prevents the UV ink containing bubbles from being supplied to the ink discharge head 361. The deaeration module 826 is connected to the pressure reducing section 84 via a negative pressure supply flow path 845 described below. The deaeration module 826 may be, for example, a module including a plurality of hollow fibers.

The check valve 827 is provided in the backward circulation path 8232. The check valve 827 reduces the flow of the UV ink from the sub tank 821 to the ink discharge head 361 in the backward circulation path 8232.

The pressure-regulating pump 83 functions as a negative pressure source to a pressure reducing buffer tank 841 described below, and a pressurizing source to a second pressure buffer tank 8521 described below. An inlet of the pressure-regulating pump 83 is connected to the pressure reducing buffer tank 841, and an outlet of the pressure-regulating pump 83 is connected to the second pressure buffer tank 8521. As the pressure-regulating pump 83, for example, a diaphragm pump may be used.

The pressure reducing section 84 reduces the pressure in the deaeration module 826. The pressure reducing section 84 includes the pressure reducing buffer tank 841, a negative pressure introduction flow path 842, a pressure reduction switching valve 843, a negative pressure sensor 844, and the negative pressure supply flow path 845.

The pressure reducing buffer tank 841 can accumulate negative pressure in an internal space thereof. To the pressure-regulating pump 83 side of the pressure reducing buffer tank 841, the negative pressure introduction flow path 842 is connected. To the deaeration module 826 side of the pressure reducing buffer tank 841, the negative pressure supply flow path 845 is connected. The pressure reduction switching valve 843 is provided in the negative pressure introduction flow path 842. The pressure reduction switching valve 843 is a three-way valve that has an air open port. The control unit 4 turns on or off the pressure reduction switching valve 843. The negative pressure introduction flow path 842 is blocked and the inlet of the pressure-regulating pump 83 is opened to the atmosphere when the pressure reduction switching valve 843 is turned off. The blocking of the negative pressure introduction flow path 842 is released and the pressure in the pressure reducing buffer tank 841 is reduced if the pressure reduction switching valve 843 is turned on.

The negative pressure sensor 844 detects a pressure in the pressure reducing buffer tank 841. Based on the detection result of the negative pressure sensor 844, the control unit 4 controls the pressure reduction switching valve 843 and the pressure-regulating pump 83. That is, if the control unit 4 determines that the pressure in the pressure reducing buffer tank 841 is higher than a predetermined value, based on the detection result of the negative pressure sensor 844, the control unit 4 causes the pressure-regulating pump 83 to operate and turns on the pressure reduction switching valve 843. By this operation, the pressure in the pressure reducing buffer tank 841 is reduced. On the other hand, if the control unit 4 determines that the pressure in the pressure reducing buffer tank 841 is lower than the predetermined value, based on the detection result of the negative pressure sensor 844, the control unit 4 stops the operation of the pressure-regulating pump 83 and turns off the pressure reduction switching valve 843. By this operation, the pressure in the pressure reducing buffer tank 841 is maintained at the predetermined pressure.

The tank pressurizing section 85 applies a pressure to the inside of the sub tank 821. The tank pressurizing section 85 includes a first pressurizing unit 851, a second pressurizing unit 852, a unit switching valve 853, and a common pressure flow path 854.

The first pressurizing unit 851 applies a pressure to the inside of the sub tank 821 to have a predetermined first pressure. As will be described below, the control unit 4 controls components such that a pressure is applied to the inside of the sub tank 821 to have the first pressure by the first pressurizing unit 851 in wiping operation. The first pressurizing unit 851 includes a pressure pump 8517, a first pressure buffer tank 8511, a first pressure introduction flow path 8512, a first pressure switching valve 8513, a first pressure sensor 8514, a first pressure supply flow path 8515, and a first pressure release valve 8516.

The pressure pump 8517 functions as a pressurizing source for the first pressure buffer tank 8511. An outlet of the pressure pump 8517 is connected to the first pressure buffer tank 8511. As the pressure pump 8517, for example, a diaphragm pump may be used.

The first pressure buffer tank 8511 can accumulate pressure in an internal space thereof. To the pressure pump 8517 side of the first pressure buffer tank 8511, the first pressure introduction flow path 8512 is connected. To the sub tank 821 side of the first pressure buffer tank 8511, the first pressure supply flow path 8515 is connected. It is preferable that the capacity of the first pressure buffer tank 8511 be one liter or more if the ability of the pressure pump 8517 is 0.05 to 0.15 l/min. With this structure, the pressure in the first pressure buffer tank 8511 can be managed in 0.1 kPa units. The first pressure switching valve 8513 is provided in the first pressure introduction flow path 8512. The first pressure switching valve 8513 is a three-way valve that has an air open port. The control unit 4 turns on or off the first pressure switching valve 8513. The first pressure introduction flow path 8512 is blocked and the outlet of the pressure pump 8517 is opened to the atmosphere if the first pressure switching valve 8513 is turned off. The blocking of the first pressure introduction flow path 8512 is released and the inside of the first pressure buffer tank 8511 is pressurized if the first pressure switching valve 8513 is turned on.

The first pressure sensor 8514 detects a pressure in the first pressure buffer tank 8511. Based on the detection result of the first pressure buffer tank 8511, the control unit 4 controls the first pressure switching valve 8513 and the pressure pump 8517. That is, if the control unit 4 determines that the pressure in the first pressure buffer tank 8511 is lower than a first pressure based on the detection result of the first pressure sensor 8514, the control unit 4 causes the pressure pump 8517 to operate and turns on the first pressure switching valve 8513. By this operation, the inside of the first pressure buffer tank 8511 is pressurized. On the other hand, if the control unit 4 determines that the pressure in the first pressure buffer tank 8511 is higher than the first pressure based on the detection result of the first pressure sensor 8514, the control unit 4 causes the pressure pump 8517 to stop and turns off the first pressure switching valve 8513. By this operation, the inside of the first pressure buffer tank 8511 is maintained at the first pressure.

The first pressure release valve 8516 is provided in the first pressure supply flow path 8515. The first pressure release valve 8516 is a three-way valve that has an air open port. The control unit 4 turns on or off the first pressure release valve 8516. The first pressure supply flow path 8515 is blocked and air in the first pressure buffer tank 8511 is released into the air if the first pressure release valve 8516 is turned on. The blocking of the first pressure supply flow path 8515 is released if the first pressure release valve 8516 is turned off. The first pressure release valve 8516 is turned on, for example, to release air in the first pressure buffer tank 8511 prior to the operation stop of the printing apparatus A, or to reduce the pressure set in the first pressure buffer tank 8511.

The second pressurizing unit 852 applies a pressure to the inside of the sub tank 821 to have a predetermined second pressure. As will be described below, the control unit 4 controls components such that a pressure is applied to the inside of the sub tank 821 to have the second pressure by the second pressurizing unit 852 in discharge cleaning operation. The second pressurizing unit 852 includes a second pressure buffer tank 8521, a second pressure introduction flow path 8522, a second pressure switching valve 8523, a second pressure sensor 8524, a second pressure supply flow path 8525, and a second pressure release valve 8526.

The second pressure buffer tank 8521 can accumulate positive pressure in an internal space thereof. To the pressure-regulating pump 83 side of the second pressure buffer tank 8521, the second pressure introduction flow path 8522 is connected. To the sub tank 821 side of the second pressure buffer tank 8521, the second pressure supply flow path 8525 is connected. The second pressure switching valve 8523 is provided in the second pressure introduction flow path 8522. The second pressure switching valve 8523 is a three-way valve that has an air open port. The control unit 4 turns on or off the second pressure switching valve 8523. The second pressure introduction flow path 8522 is blocked and the outlet of the pressure-regulating pump 83 is opened to the atmosphere if the second pressure switching valve 8523 is turned off. The blocking of the second pressure introduction flow path 8522 is released and the inside of the second pressure buffer tank 8521 is pressurized if the second pressure switching valve 8523 is turned on.

The second pressure sensor 8524 detects a pressure in the second pressure buffer tank 8521. Based on the detection result of the second pressure buffer tank 8521, the control unit 4 controls the second pressure switching valve 8523 and the pressure-regulating pump 83. That is, if the control unit 4 determines that the pressure in the second pressure buffer tank 8521 is lower than a second pressure based on the detection result of the second pressure sensor 8524, the control unit 4 causes the pressure-regulating pump 83 to operate and turns on the second pressure switching valve 8523. By this operation, the inside of the second pressure buffer tank 8521 is pressurized. On the other hand, if the control unit 4 determines that the pressure in the second pressure buffer tank 8521 is higher than the second pressure based on the detection result of the second pressure sensor 8524, the control unit 4 causes the pressure-regulating pump 83 to stop and turns off the second pressure switching valve 8523. By this operation, the inside of the second pressure buffer tank 8521 is maintained at the second pressure.

The second pressure release valve 8526 is provided in the second pressure supply flow path 8525. The second pressure release valve 8526 is a three-way valve that has an air open port. The control unit 4 turns on or off the second pressure release valve 8526. The second pressure supply flow path 8525 is blocked and air in the second pressure buffer tank 8521 is released into the air if the second pressure release valve 8526 is turned on. The blocking of the second pressure supply flow path 8525 is released if the second pressure release valve 8526 is turned off. The second pressure release valve 8526 is turned on, for example, to release air in the second pressure buffer tank 8521 prior to the operation stop of the printing apparatus A, or to reduce the pressure set in the second pressure buffer tank 8521.

The unit switching valve 853 switches the pressurizing unit for pressurizing the inside of the sub tank 821 between the first pressurizing unit 851 and the second pressurizing unit 852. The unit switching valve 853 is a three-way valve. The control unit 4 turns on or off the unit switching valve 853. To a common port of the unit switching valve 853, a common pressure flow path 854 that communicates with the sub tank 821 is connected, and to the other two ports, the first pressure supply flow path 8515 and the second pressure supply flow path 8525 are connected. The common pressure flow path 854 (sub tank 821) communicates with the first pressure supply flow path 8515 (first pressurizing unit 851) if the unit switching valve 853 is turned on. By this operation, the inside of the sub tank 821 is pressurized to the first pressure by the first pressurizing unit 851. The common pressure flow path 854 (sub tank 821) communicates with the second pressure supply flow path 8525 (second pressurizing unit 852) if the unit switching valve 853 is turned off. By this operation, the inside of the sub tank 821 is pressurized to the second pressure by the second pressurizing unit 852.

One end portion of the common pressure flow path 854 is connected to the unit switching valve 853, and the other end portion of the common pressure flow path 854 is connected to an upper space of the sub tank 821. To the common pressure flow path 854, the tank release valve 86 is provided.

The tank release valve 86 is a three-way valve that has an air open port. The control unit 4 turns on or off the tank release valve 86. The common pressure flow path 854 is blocked and the inside of the sub tank 821 is opened to the atmosphere if the tank release valve 86 is turned off. The blocking of the common pressure flow path 854 is released and the pressurization of the inside of the sub tank 821 by the tank pressurizing section 85 can be performed if the tank release valve 86 is turned on. The tank release valve 86 is turned off in print operation, and turned on in wiping operation or discharge cleaning operation.

The discharge cleaning processing and the wiping processing performed in the printing apparatus A of the above-described structure will be described. In the printing apparatus A, for example, if the power supply is turned on or the printing apparatus A receives a maintenance execution instruction, the process unit 36 is moved to the automatic maintenance position P2 (see FIG. 2), and the discharge cleaning processing and the wiping processing are performed in this order.

In the discharge cleaning processing, the caps 62 are moved to the positions opposite to the ink discharge head 361 by the maintenance moving mechanism 64, and capping of the ink discharge head 361 is performed with the caps 62. Further, the circulation pump 824 operates at a high speed. The unit switching valve 853 is turned off, and the inside of the sub tank 821 is pressurized to the second pressure by the second pressurizing unit 852. Then, the capping is released to discharge the UV ink from the nozzle of the ink discharge head 361 toward the caps 62.

In the subsequent wiping processing, the unit switching valve 853 is turned on, and the inside of the sub tank 821 is pressurized to the first pressure that is lower than the second pressure by the first pressurizing unit 851. The operation of the circulation pump 824 is stopped. In this state, the wiper 61 is moved by the maintenance moving mechanism 64, and wiping of the nozzle surface 3611 of the ink discharge head 361 is performed. With this wiping operation, the UV ink adhered to the nozzle surface 3611 is wiped by the discharge cleaning operation.

It is preferable that the head back pressure in the wiping operation be higher than a head back pressure (for example, −1 kPa) in the print operation, and be, for example, preferably, −0.75 kPa or more and −0.45 kPa or less. If the head back pressure in the wiping operation is lower than a value in the range, bubbles or foreign materials (for example, polymer substances of the UV ink) may enter from the nozzle of the ink discharge head 361 during the wiping operation. In this regard, the head back pressure in the wiping operation becomes lower than the desired range only with a head difference (for example, about 200 mm) between the nozzle surface 3611 of the ink discharge head 361 and the surface of ink in the sub tank 821.

To solve the problem, in the wiping operation, the ink circulation speed in the ink circulation flow path 823 may be increased to a speed higher than that in the print operation, that is, the head back pressure may be controlled within the desired range by increasing the rotational speed of the circulation pump 824 to generate a pressure loss of the UV ink. However, the circulation of the UV ink in the wiping operation changes the temperature of the UV ink, and this causes variation in the viscosity of the UV ink. This causes variation in the pressure loss of the UV ink in the ink circulation flow path 823, and it is difficult to control the head back pressure to fall within the desired range only by the control of the rotational speed of the circulation pump 824. Under this circumstances, in the printing apparatus A, instead of circulating the UV ink in the wiping operation, the inside of the sub tank 821 is pressurized to the first pressure so as to control the head back pressure in the wiping operation to fall within the desired range.

As described above, the printing apparatus A according to the embodiment includes the ink discharge head 361 that discharges the UV ink, the wiper 61 that wipes the ink discharge head 361, the sub tank 821 that stores the UV ink to be supplied to the ink discharge head 361, the ink circulation flow path 823 that includes the forward circulation path 8231 and the backward circulation path 8232, the circulation pump 824 that circulates the UV ink in the ink circulation flow path 823, and the first pressurizing unit 851 that pressurizes the inside of the sub tank 821 in the wiping operation to the first pressure that is higher than the pressure (atmospheric pressure) in the sub tank 821 in the print operation. The circulation pump 824 stops the operation in the wiping operation. In this structure, in the wiping operation, the inside of the sub tank 821 is pressurized to the first pressure by the first pressurizing unit 851. This increases the head back pressure in the wiping operation to a head back pressure higher than that in the print operation. Further, the circulation of the UV ink is stopped in the wiping operation. Consequently, the amount of variation of the head back pressure due to variation in viscosity of the UV ink can be reduced. Accordingly, with this structure, the control of the head back pressure in the wiping operation can be accurately performed such that the head back pressure in the wiping operation is higher than the head back pressure in the print operation.

The printing apparatus A according to the embodiment further includes the second pressurizing unit 852 that pressurizes the inside of the sub tank 821 to the second pressure that is higher than the first pressure, and the unit switching valve 853. The unit switching valve 853 switches the pressurizing unit for pressurizing the inside of the sub tank 821 to the first pressurizing unit 851 in the wiping operation, and to the second pressurizing unit 852 in the discharge cleaning operation. In this structure, in the wiping operation, the pressurizing unit for pressurizing the inside of the sub tank 821 is switched to the first pressurizing unit 851, and thereby the inside of the sub tank 821 is pressurized to the first pressure. On the other hand, in the discharge cleaning operation, the pressurizing unit for pressurizing the inside of the sub tank 821 is switched to the second pressurizing unit 852, and thereby the inside of the sub tank 821 is pressurized to the second pressure. Consequently, according to the structure, the pressure for pressurizing the inside of the sub tank 821 can be immediately switched in the wiping operation and in the discharge cleaning operation. In a case where the discharge cleaning operation and the wiping operation are performed to the six ink discharge heads 361 one by one, the switching of the pressurizing units for pressurizing the inside of the sub tank 821 is frequently performed, however, with this structure, the total processing time can be reduced.

The printing apparatus A according to the embodiment includes the first pressurizing unit 851 that includes the pressure pump 8517, the first pressure buffer tank 8511 provided between the pressure pump 8517 and the sub tank 821, and the first pressure sensor 8514 that detects a pressure in the first pressure buffer tank 8511. Based on the detection result of the first pressure sensor 8514, the pressure pump 8517 is controlled. With this structure, the pressure in the first pressure buffer tank 8511 can be accurately controlled. Accordingly, by the first pressure buffer tank 8511 that has been controlled to have an appropriate pressure, the inside of the sub tank 821 can be pressurized.

The wiper 61 is an example of a "wiping member". The sub tank 821 is an example of an "ink storage section". The circulation pump 824 is an example of a "circulation section". The first pressurizing unit 851 is an example of a "first pressurizing section". The second pressurizing unit 852 is an example of a "second pressurizing section". The unit switching valve 853 is an example of a "switching valve". The tank release valve 86 is an example of an "air open valve". It is to be understood that the present invention is not limited to the above-described embodiment, various modifications thereof can be made without departing from the scope of the invention. For example, the ink used in the printing apparatus A is not limited to the UV ink, water-based ink, oil-based ink, solvent ink, or sublimation ink may be used.

The entire disclosure of Japanese Patent Application No. 2015-082733, filed Apr. 14, 2015 is expressly incorporated by reference herein.

What is claimed is:

1. A printing apparatus comprising:

an ink discharge head that discharges ink;

a wiping member that wipes the ink discharge head;

an ink storage section that stores the ink to be supplied to the ink discharge head;

an ink circulation flow path including a forward circulation path through which the ink supplied from the ink storage section to the ink discharge head flows, and a backward circulation path through which the ink returning from the ink discharge head to the ink storage section flows;

a circulation section that causes the ink to circulate in the ink circulation flow path; and a first pressurizing section that pressurizes the inside of the ink storage section in wiping operation in which the ink discharge head is wiped with the wiping member to a first pressure that is higher than a pressure in the ink storage section in print operation for discharging the ink toward a print medium with the ink discharge head, wherein the circulation section stops causing the ink to circulate in the ink circulation flow path during the wiping operation.

2. The printing apparatus according to claim 1, further comprising:

a second pressurizing section that pressurizes the inside of the ink storage section to a second pressure that is higher than the first pressure; and a switching section that performs switching between the first pressurizing section in the wiping operation and the second pressurizing section in discharge cleaning operation in which the ink is discharged from the ink discharge head.

3. The printing apparatus according to claim 2, wherein the switching section includes a switching valve for switching between a state in which the first pressurizing section communicates with the ink storage section and a state in which the second pressurizing section communicates with the ink storage section.

4. The printing apparatus according to claim 1, wherein the first pressurizing section includes:

a pressure pump that is to be a pressurizing source, a first pressure buffer tank provided between the pressure pump and the ink storage section, and a first pressure sensor that detects a pressure in the first pressure buffer tank and wherein the pressure pump is controlled based on the detection result of the first pressure sensor.

5. The printing apparatus according to claim 1, further comprising:

an air open valve that releases the inside of the ink storage section to the atmosphere in the print operation.

6. The printing apparatus according to claim 1, wherein the ink discharge head discharges ultraviolet ink as the ink.

7. A maintenance method for a printing apparatus including:

an ink discharge head that discharges ink;

a wiping member that wipes the ink discharge head;

an ink storage section that stores the ink to be supplied to the ink discharge head;

an ink circulation flow path including a forward circulation path through which the ink supplied from the ink storage section to the ink discharge head flows, and a backward circulation path through which the ink returning from the ink discharge head to the ink storage section flows; and a circulation section that causes the ink to circulate in the ink circulation flow path, the method comprising:

pressurizing the inside of the ink storage section in wiping operation in which the ink discharge head is wiped with the wiping member to a first pressure that is higher than a pressure in the ink storage section in print operation for discharging the ink toward a print medium with the ink discharge head and stopping the circulation section from causing the ink to circulate in the ink circulation flow path during the wiping operation.

* * * * *